United States Patent [19]

Davies et al.

[11] 4,050,568

[45] Sept. 27, 1977

[54] STYLUS CARRIAGE DRIVE

[75] Inventors: Michael LaVar Davies, American Fork; Richard Servern Johnson; Alvin John Noker, both of Bountiful; Veldon Lawrence Wilde, Centerville, all of Utah

[73] Assignee: Sperry Rand Corporation, New York, N.Y.

[21] Appl. No.: 637,973

[22] Filed: Dec. 5, 1975

[51] Int. Cl.[2] ..... B41J 19/20

[52] U.S. Cl. ..... 197/90; 346/139 D

[58] Field of Search ..... 197/1 R, 60, 90, 82 R, 197/113; 101/93.04, 93.05; 346/139 D

[56] References Cited

U.S. PATENT DOCUMENTS

| | | | |
|---|---|---|---|
| 1,754,503 | 4/1930 | Dwelle | 346/139 D X |
| 2,622,001 | 12/1952 | Cooley | 346/139 D |
| 3,300,017 | 1/1967 | Yazejian et al. | 197/1 R |
| 3,592,311 | 7/1971 | Chou et al. | 101/93.05 X |
| 3,750,792 | 8/1973 | Liles | 197/1 R |
| 3,806,948 | 4/1974 | Nagao et al. | 346/139 D X |
| 3,817,365 | 6/1974 | Zimmermann | 197/1 R |
| 3,845,850 | 11/1974 | Herr et al. | 197/1 R |
| 3,881,587 | 5/1975 | Okabe | 197/1 R |
| 3,900,094 | 8/1975 | Larsen et al. | 197/1 R |
| 3,945,481 | 3/1976 | Lindberg | 197/90 |

*Primary Examiner*—Ernest T. Wright, Jr.

*Attorney, Agent, or Firm*—John R. Flanagan; Marshall M. Truex

[57] ABSTRACT

A stylus carriage drive comprising a lead screw having a stylus carriage mounted thereon which moves linearly in one direction or the other depending on the sense of rotation of the lead screw. The stylus carriage includes means which cause a print head mounted on the stylus to engage the print medium when the stylus carriage moves in the print direction and to disengage the print medium during carriage return.

1 Claim, 5 Drawing Figures

STYLUS CARRIAGE DRIVE

BACKGROUND OF THE INVENTION

In printers wherein the print technology used requires continuous engagement of the print head with the print medium during the print mode and disengagement of the print head from the print medium during the return carriage mode, control means are required to bring the print head into contact with the print medium at the beginning of the print cycle and to remove the print head from the print medium during the return cycle.

In one such printing method where a stylus carriage is mounted on a lead screw which on rotation in one direction causes the stylus carriage to move linearly in one direction and on rotation of the lead screw in the other direction causes the stylus to move linearly in the opposite direction, independent mechanical means are used to move and hold the stylus carriage in the print position during the print cycle and to move the stylus carriage away from the print medium during the carriage return mode. Such an arrangement requires an independent mechanical means, a motor to drive the mechanical means, limit switches for detecting end of the print and return carriage cycle as well as complex electronic circuit to sequence and drive the mechanical means.

The present invention contemplates a stylus carraige drive which utilizes a stylus carriage mounted on a lead screw of which the direction of rotation determines the linear direction of stylus carraige movement. In addition, the present invention includes means associated with the stylus carriage which causes automatic angular rotation of the stylus carriage in one or the other direction depending on the rotational direction of the lead screw. This arrangement eliminates the need for an independently controlled mechanical means. Thus, the stylus carriage of the present invention automatically assumes the print position, i.e., the print head in contact with the print medium during rotation of the lead screw in one direction and automatically resumes the non-print position, i.e., the print head out of engagement with the print medium when the lead screw is rotated in the opposite direction during carriage return. A stationary rod is used in conjunction with the stylus carriage drive to limit rotation of the stylus carriage on the lead screw to insure linear movement while at the same time permitting sufficient rotation of the stylus carriage to allow engagement and disengagement of the print head vis-a-vis the print medium.

More specifically friction creating means are associated with the stylus carriage which causes automatic orientation of the print head into and out of print position as the lead screw rotates in one or the other direction. This friction creating means comprises a spring interposed between a nut and the stylus carriage. The nut as well as the stylus carriage has threads which mesh with the threads on the lead screw. The spring causes the threads of the nut and stylus carriage to bear against opposite sides of the threads of the lead screw in opposite directions. The frictional force is self-adjusting inasmuch as wear of the threads is compensated by the spring arrangement, which maintains a constant force.

OBJECTS

It is an object of the present invention to provide a stylus carriage drive arrangement which eliminates the need for independently activated means for moving the stylus into and out of engagement with the print mechanism.

Another object of the present invention is to provide a stylus carriage driven by a lead screw which automatically moves into and out of engagement with the print medium in accordance with the rotational direction of the lead screw.

A further object of the present invention is to provide a stylus carriage drive arrangement which provides linear motion of the stylus and partial angular rotation of the stylus between set limits.

Other objects and many of the attendant advantages of the present invention will become apparent upon reading the following description in conjuction with the accompanying drawing.

DESCRIPTION OF THE INVENTION

Figures 1, 2, 3, 4, 5:
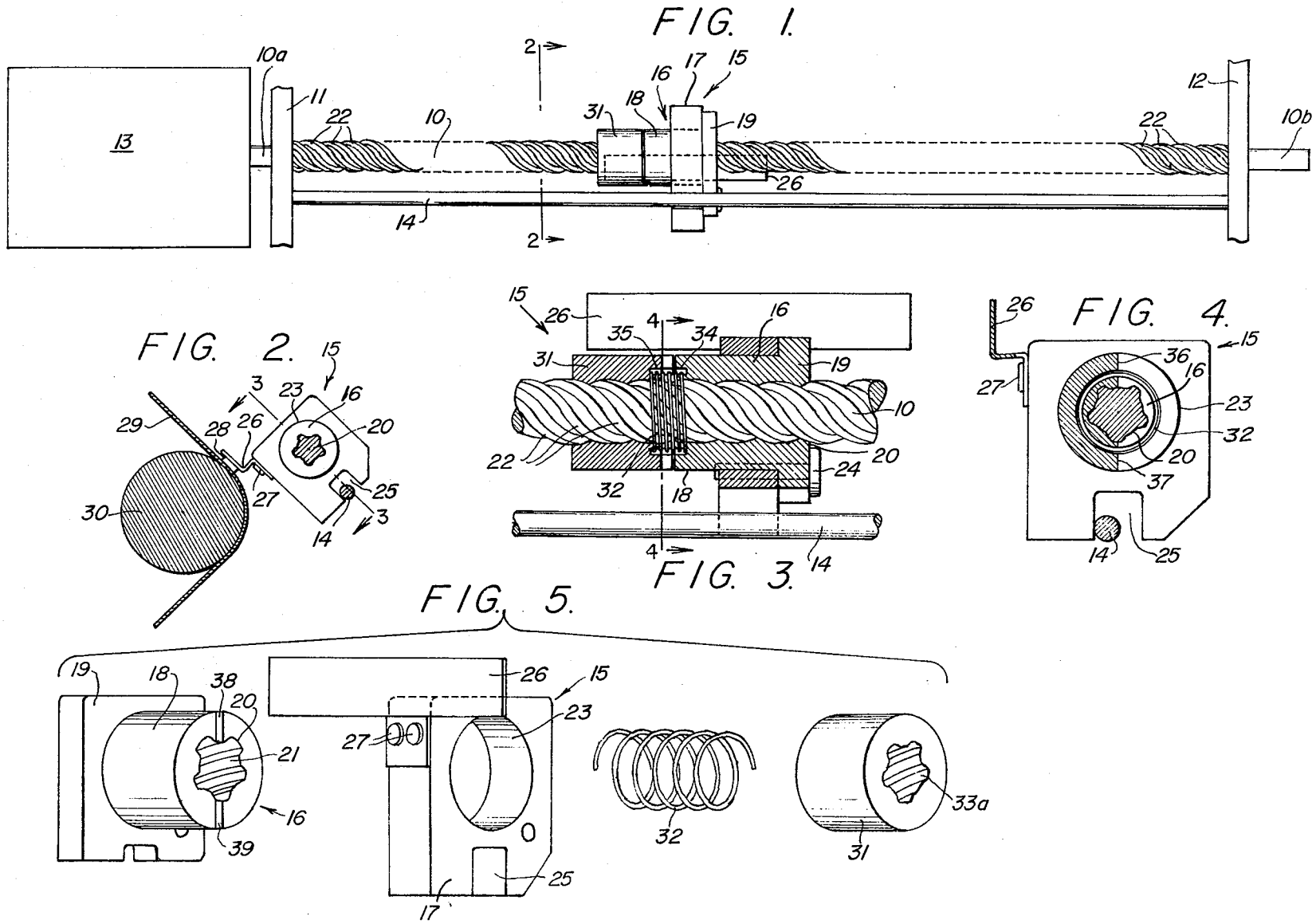
FIG. 1 is a front view of the stylus carriage drive of the present invention.
FIG. 2 is a left side view of the stylus carriage drive of FIG. 1 taken through line 2—2 of FIG. 1.
FIG. 3 is a sectional view of the stylus carriage of the present invention taken through line 3—3 of FIG. 2.
FIG. 4 is a sectional view of the stylus carriage taken through line 4—4 of FIG. 3.
FIG. 5 is an exploded assembly view of the stylus carriage of the present invention.

Referring now more particularly to FIG. 1, there is shown a lead screw 10 fixed for rotation between frame elements 11 and 12. The frame elements 11 and 12 may be the side frames of, or other support means within, a printer in which the present invention finds use. The ends 10*a* and 10*b* of the lead screw 10 are mounted for rotation in bearings within the frame elements 11 and 12 (not shown). The lead screw 10 may be made of stainless steel or other similarly hard material. The lead screw 10 is threaded in a well-known manner as by machining or by rolling in dies.

A motor 13 has a shaft directly attached to the end 10*a* of the lead screw 10. The motor 13 may be connected to the end 10*a* of the lead screw 10 in any convenient manner, for example, by a pin and hole arrangement. However, the manner of connection is not shown, and the end 10*a* of the lead screw 10 may be thought of as part of the shaft of the motor 13. The motor 13 may be a bi-directional D.C. motor for turning the lead screw 10 in the clockwise or counterclockwise direction depending on the print cycle. For example, the motor 13 turns the lead screw 10 in a clockwise direction during the print mode and in a counterclockwise direction during the return carriage mode.

The rod 14 also extends between the frame elements 11 and 12. the ends of the rod 14 are secured in the frame elements 11 and 12 in any convenient manner such that it is stationary and fixed relative to the lead screw 10 in the frame elements 11 and 12.

A stylus carriage 15 is disposed in rotational relationship on the lead screw 10.

In a practical embodiment the stylus carriage 15 comprises an element 16 and a stylus mounting element 17.

The element 16 comrpises a neck portion 18 and a flat portion 19 which may be integrally formed from a single piece of material such as Delrin A.F. or equivalent plastic.

As best seen in FIG. 2 a circular opening 20 passes through the length of the element 16 and has internal threads 21 formed therein. The threads 21 may be formed as by machining and mesh with threads 22 formed on the lead screw 10.

The stylus mounting element 17 is a substantially rectangular member having a circular opening 23 through its short dimension. The circular opening 23 has a diameter substantially equal to, or slightly greater than the external diameter of the neck portion 18 which permits it to be mounted on the neck portion 18. A screw 24 secures the flat portion 19 to the stylus mounting element 17. Other means of securing the flat portion 19 to the stylus mounting element 17 such as a plastic adhesive may be used. Alternatively, the element 16 and stylus mounting element 17 may be integrally formed from a single piece of material eliminating the need for the screw 24 in the flat portion 19 of the element 16. However, for ease of assembly and adjustment, a two-piece stylus carriage 15 was found practical.

As best seen in FIGS. 2 and 4, the stylus mounting element 17 includes a slot 25 or has formed therein a slot 25. As may be seen the slot 25 straddles the rod 14 when the stylus carriage 15 is in place on the lead screw 10. The width of the slot 25 is dependent on the separation distances of lead screw 10 and rod 14 as well as the rotational movement requirements.

As will be explained more fully herein below, the rod 14 limits rotation of the stylus carriage 15 on the lead screw 10 to insure linear movement while at the same time permitting sufficient rotation of the stylus carriage 15 to allow engagement and disengagement of the print head or stylus 28 to and from the print medium 29.

As seen in FIGS. 2 and 4, the stylus mounting element 17 has an 'L'-shaped form 26 secured thereto as by a screw 27. As seen in FIG. 2 the form 26 has mounted thereon a print head or stylus 28. In Fig. 2 the stylus carriage 15 is shown in the print position with the print head 28 contacting the print medium 29.

FIG. 2 shows in outline a platen 30 and a sheet of the print medium 29 against which the print head 28 bears during the print mode. While the present invenion is adapted to be used in any printer wherein the print head 28 must be moved along the print medium 29 in contiguous relationship therewith, it should be noted that in a practical embodiment, the stylus carriage drive of the present invention is used in the image-burn technology wherein the paper or print medium 29 has an aluminum coating and the front paper surface is grounded by means not shown. The print head 28 would comprise a plurality of wires which as they pass over the aluminized paper are energized in accordnce with the data to be printed and burn a matrix or pattern of alphanumeric symbols onto the print medium 29. During carriage return, the print head 28 is removed from contact with the print medium 29.

An essential feature of the present invention consists in the manner in which the print head 28 is automatically brought to bear on the print medium 29 during the printing mode and in which the print head 28 is automatically moved from contact with the print medium 29 during the returned carriage move. The foregoing is accomplished by means of a friction nut 31 which in cooperation with neck portion 18 and a spring 32 creates a frictional force between the stylus carriage 15 and the lead screw 10 such that the stylus carriage 15 tends to follow the rotational movement of the lead screw 10. As will become more apparent herein below, when the motor 13 causes the lead screw 10 to rotate in the clockwise direction the stylus carriage 15 will move such that the print head 28 contacts the print medium 29; and when during carriage return the motor 13 reveses the direction of the lead screw 10 to counterclockwise, the print head 28, by virtue of the friction-created force discussed above is removed from the print medium 29.

The friction nut 31 is a tubular element having an internally-threaded opening 33 through its length. The threads 33*a* of the friction nut 31 mesh with the threads 22 of the lead screw 10. As seen in FIG. 3, the friction nut 31 formed therein an annular recess 35 concentric with the opening therethrough. In a similar manner the neck portion 18 of element 16 has formed therein an annular recess 34 as best seen in FIG. 3 which is concentric with the threaded circular opening 20 therein.

A semiciruclar portion of the friction nut 31 extends slightly outwardly to form edges 36 and 37. In a similar manner a semicircle of the neck portion 18 also extends out to form edges 38 and 39 which are complementary with the edges 36 and 37 of the friction nut 31.

The spring 32 having a diameter equal to the diameters of the annular recesses 34 and 35 and a thickness slightly less than the thicknesses of annular recesses 34 and 35 is disposed over the lead screw 10. As shown in FIG. 3 when the stylus carriage 15 and the friction nut 31 are threaded onto the lead screw 10, the spring 32 is compressed therebetween. In this position the spring 32 is contained almost entirely within the annular recesses 34 and 35 with the edges 36 and 37 of the friction nut 31 juxtaposed with the edges 38 and 39 of the neck portion 18 such that the spring 32 tends to force the stylus carriage 15 and the friction nut 31 in opposite directions. This opposing force causes the internal threads 21 in opening 20 of element 16 to bear against the lead screw threads 22 in a direction opposite to the direction in which the friction nut threads 33 are forced to bear against the lead screw threads 22. Thus, when in place the stylus carriage 15 in conjunction with the friction nut 31 form a unitary structure on the lead screw 10 which by virtue of the frictional force just described causes the stylus carriage 15 to tend to move with the lead screw 10 as it rotates in the clockwise or counterclockwise direction.

However, because of the rod 14 disposed within the slot 25, the movement of the stylus carriage 15 is limited to the distance by which the slot 25 is wider than the diameter of the rod 14. Thus, on turning the lead screw 10 via the motor 13 in either the clockwise or counterclockwise direction, the stylus carriage 15 is forced to move from left to right or right to left, respectively, linearly, for acccomplishing its movement in the print mode and carriage-return mode. Inasmuch as the stylus carriage 15 is permitted limited movement by the difference in the distance the width of the slot 25 and the rod 14, it can be seen that when the lead screw 10 is turned clockwise, the stylus carriage 15 rotates on the lead screw 10 such that the print head 28 contacts the print medium 29 in the print mode; and when the rotational direction of the lead screw 10 is reversed at the end of the print mode and caused to rotate in a counterclockwise direction, the print head 28 moves away from the print medium 29 during the carriage return mode. The foregoing function being accomplished by the above-discussed friction force between the friction nut 31 and the element 16 acting in conjunction with the stationary rod 14.

Other modifications of the present invention are possible in the light of the above description, and no limitation should be placed on the invention other than those set forth in the following claims.

We claim:

1. In a printer a stylus carriage arrangement for moving a stylus into and out of engagement with a print medium during the print and return carriage cycle, respectively, comprising in combination;

an externally-threaded lead screw;

support means for supporting the ends of said lead screw for rotational movement therein;

motor means connected to said lead screw for rotating said lead screw in a clockwise direction for the print cycle and in a counterclockwise direction for the carriage return cycle;

a stylus carriage mounted on said lead screw through an opening having internal threads which mesh with the threads of said lead screw;

a nut mounted on said lead screw via an internally-threaded opening; and a spring disposed on said lead screw between said nut and said stylus carriage creating an axial opposing force between said nut and said stylus carriage;

said stylus carriage and said nut having annular recesses concentric with the respective openings therethrough for receiving said spring enabling said stylus carriage and said nut to be disposed on said lead screw in contiguous relationship with said spring compressed therebetween;

each of said stylus carriage and said nut having semicircular portions extending therefrom forming complementary abutting edges to prevent relative rotational movement of said stylus carriage and said nut and to cause said spring to be substantially entirely contained in said annular recesses when said edges are in contiguous relationship;

a rod held stationary by said support means;

said stylus carriage having a slot formed therein having a width somewhat greater than the diameter of said rod;

said rod disposed within said slot enabling said stylus carriage to rotate on said lead screw only a predetermined distance in either direction; and a stylus disposed on said stylus carriage which is moved into a print position and away from a print position when said lead screw is rotated in a first or second direction, respectively, by said motor means.

* * * * *